US007658516B2

(12) United States Patent
McCauley

(10) Patent No.: US 7,658,516 B2
(45) Date of Patent: Feb. 9, 2010

(54) DECORATIVE LAMP COVER

(76) Inventor: Mark C. McCauley, 3115 S. Federal Hwy., Delray Beach, FL (US) 33483

( * ) Notice: Subject to any disclaimer, the term of this patent is extended or adjusted under 35 U.S.C. 154(b) by 0 days.

(21) Appl. No.: 11/860,574

(22) Filed: Sep. 25, 2007

(65) Prior Publication Data

US 2009/0080203 A1 Mar. 26, 2009

(51) Int. Cl.
*F21V 11/00* (2006.01)

(52) U.S. Cl. ..... 362/351; 362/368; 362/353; 362/806; 362/363

(58) Field of Classification Search ..... 362/351, 362/255, 311, 153, 353, 808, 806, 368, 363
See application file for complete search history.

(56) References Cited

U.S. PATENT DOCUMENTS 2,816,378 A * 12/1957 Levinson ..... 40/541
4,833,580 A * 5/1989 Allen ..... 362/451
5,567,045 A * 10/1996 Bucek ..... 362/363
6,629,770 B2 * 10/2003 Blatherwick ..... 362/363
6,705,743 B1 * 3/2004 Elembaby et al. ..... 362/249
6,902,297 B1 * 6/2005 Fung ..... 362/255
7,156,537 B1 * 1/2007 Cohrs ..... 362/147
2001/0036073 A1 * 11/2001 Trease ..... 362/154

* cited by examiner

*Primary Examiner*—Sandra L O'Shea
*Assistant Examiner*—Jessica L McMillan
(74) *Attorney, Agent, or Firm*—Mayback & Hoffman PA; Gregory L. Mayback; Scott D. Smiley

(57) ABSTRACT

A decorative light cover for an outdoor light source includes a substantially rigid skin with a shape that defines a void within an interior of the skin, an opening in a first portion of the skin, and an ornamental design on a second portion of the skin, wherein the opening is able to accept into the void a light source affixed to a structure, the skin is able to adhere to at least a portion of the light source, and the ornamental design is able to receive light from a light-radiating portion of the light source and allow the light to project through and away from the skin.

16 Claims, 4 Drawing Sheets

DECORATIVE LAMP COVER

FIELD OF THE INVENTION

The present invention relates generally to holiday decorations, and more particularly relates to a sleeve with a holiday or special event-related pattern that fits over an exterior light attached to a building.

BACKGROUND OF THE INVENTION

Exterior light fixtures, such as light 100 shown in FIG. 1, are well known. The light 100 is of the type found on many homes 102 in a typical neighborhood. The light 100 has a light bulb 104 and power is fed to the bulb 104 though a conductor 106 that is connected to a remote power source within the house 102. Although the style of the light 100 varies from home to home, the purpose is consistent—to provide light to the front of the structure 102. In most instances, the light fixture 100 can be seen from the street and has a decorative effect.

Many people enjoy expressing themselves on special occasions, such as the Fourth of July, Halloween, Christmas, birthday parties, baby showers, and many others. This expression is often in the form of, for example, signs, banners, objects in the yard, and internally-lighted ornaments. Internally-lighted ornaments can be, for example, a pumpkin with a light bulb inside, a plastic snowman with a light bulb inside, or other similar devices. However, the light bulbs must receive power from a power source. This requires a user to install the ornament somewhere in the front of their house and to run an electrical conductor to a receptacle that supplies power to the ornament. If the receptacle is not close to the ornament, a long conductor, such as an extension cord, is required. The extension cord is vulnerable to tripping people and presents an electrical hazard. If no receptacle is available on the exterior of the house, the electrical conductor must be run to the interior of the structure, which may prevent a window or door from being able to be shut securely. This renders the home vulnerable to break-ins and theft. In addition, setting up and powering the ornament takes time and effort. Furthermore, free-standing ornaments are susceptible to falling over in high winds.

Therefore, a need exists to overcome the problems with the prior art as discussed above.

SUMMARY OF THE INVENTION

Briefly, in accordance with the present invention, disclosed is a light cover that includes a body defining an interior void for receiving a light source affixed to a structure. An opening in a first portion of the body has a closed position and an open position in which the light source can be inserted into the interior of the body. A structure support portion at the opening is shaped to support and balance the body on the light source when the light source is inserted within the interior. A second portion of the body has an ornamental design, wherein the ornamental design and at least a portion of the body surrounding the ornamental design has differing translucences such that light emitted from the void enhances visibility of the ornamental design from outside the skin.

In accordance with another feature, an embodiment of the present invention includes fastener that is attached to on opening on the body and selectively couples a first side of the opening to a second side.

In accordance with a further feature of the present invention, the ornamental design is at least partially defined by recessed areas in the body.

In accordance with yet another feature of the present invention, the ornamental design is a holiday-related image, a holiday-related shape, and/or text.

In accordance with an additional feature of the present invention, the shape is at least one of curved, square, and a holiday figure.

In accordance with a further feature, the present invention includes a skin that has a closable opening for accepting a light source into an interior portion of the skin and adhering to the light source, a decorative portion, and a translucence allowing light to pass from the light source, through the skin, and away from the skin.

In accordance with another feature, an embodiment of the present invention also includes a cover for covering an exterior lamp attached to a building, where the cover includes a skin having a holiday-related design, a shape defining a lamp-holding void, an opening fluidically connected to the void when in an open position, a clasping mechanism operable for holding the opening in a closed position, and a translucence for allowing light to pass from the light source, through the skin, and away from the skin.

BRIEF DESCRIPTION OF THE DRAWINGS

The accompanying figures, where like reference numerals refer to identical or functionally similar elements throughout the separate views and which, together with the detailed description below, are incorporated in and form part of the specification, serve to further illustrate various embodiments and to explain various principles and advantages all in accordance with the present invention.

DETAILED DESCRIPTION

Figure 1:
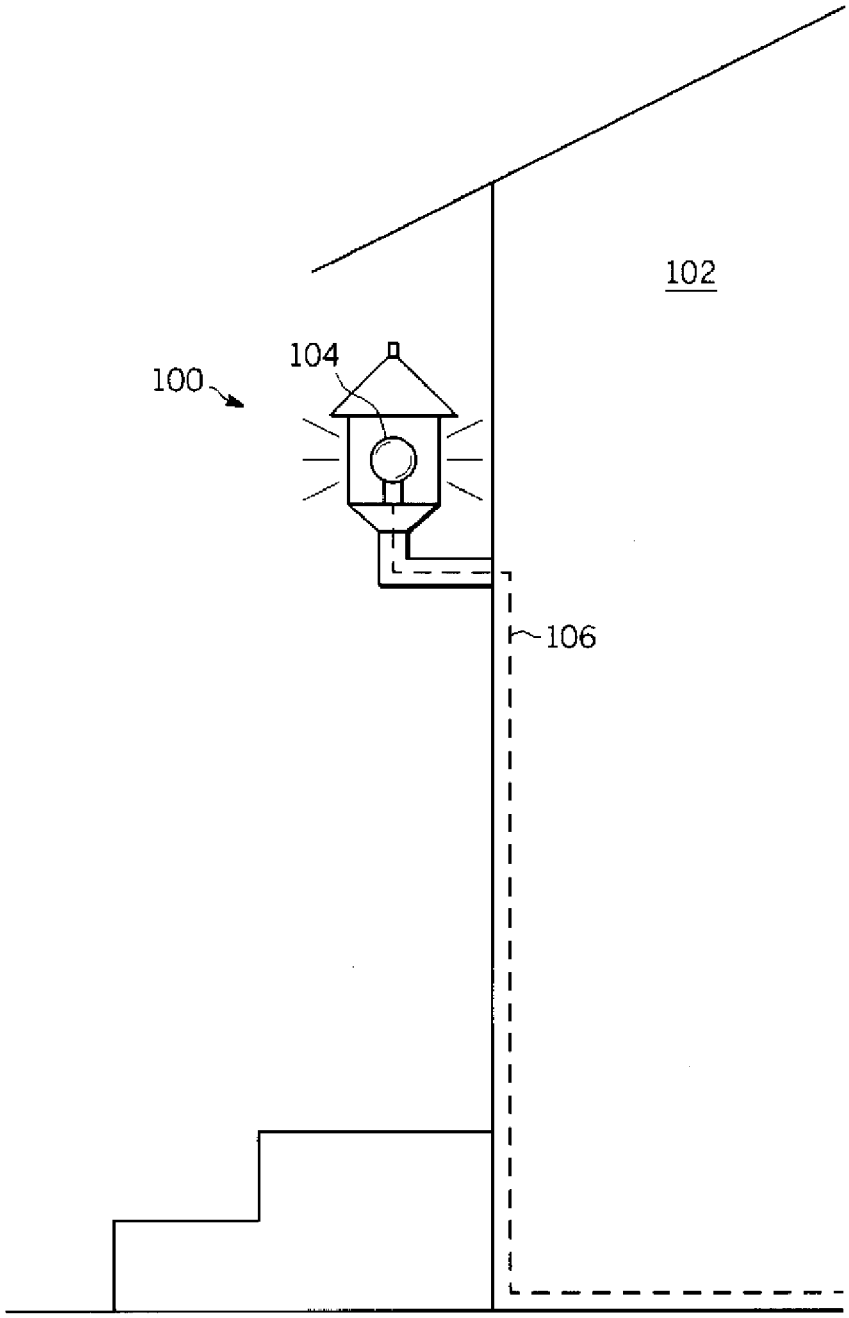
Prior Art FIG. 1
FIG. 1 is a fragmentary, side elevational view of a building structure with a fixed prior art external light source.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

The present invention provides a novel decorative lamp covering that easily slips onto existing exterior lighting fixtures attached to building structures and provides a visually stimulating and pleasant effect. The invention can be provided in many embodiments, allowing a user to express him or herself for virtually any special event or occasion.

Figure 2:
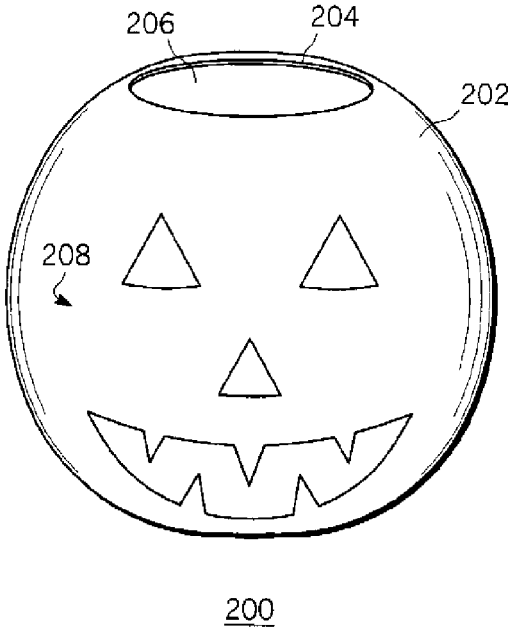
FIG. 2 is a perspective view of a decorative skin in accordance with the present invention.

Referring now to FIG. 2, one embodiment of the present invention is shown. FIG. 2 illustrates several advantageous features of the present invention, but, as will be described below, the invention can be provided in several shapes, sizes, combinations of features and components, and varying numbers and functions of the components. In this first embodiment of FIG. 2, the inventive decorative cover 200 includes a substantially rigid skin 202 that is shaped with a curve 204 that defines a void 206 within an interior of the skin 202. As used herein, substantially rigid or semi-rigid means retaining its shape under normal forces (i.e., slight bending or flexing by hand) and outdoor temperatures (e.g., −10 to 105 degrees Fahrenheit). The decorative cover 200 has an ornamental design 208 on a portion of the skin 202, in this case, a jack-o-lantern face. In one embodiment, the skin 202 is a semi-rigid plastic material that is inexpensive to make, light weight, and durable. The skin 202, however, can be made of any material that is suitable for attachment to a light fixture. The skin 202 can have a translucent quality that allows light to pass from the light source 100, through the skin 202, and away from the skin 202, where it can be seen by viewers a distance away. Many plastics, if provided in sufficiently thin dimensions, provide this translucence. Other material may also be used. In one embodiment, the translucent attribute allows a light source to illuminate all portions of the cover 200 except for the design 208, which is opaque or otherwise has a translucence that differs from that of the rest of the cover 200. In other embodiments, only the design is translucent and the rest of the cover is opaque.

Figure 3:
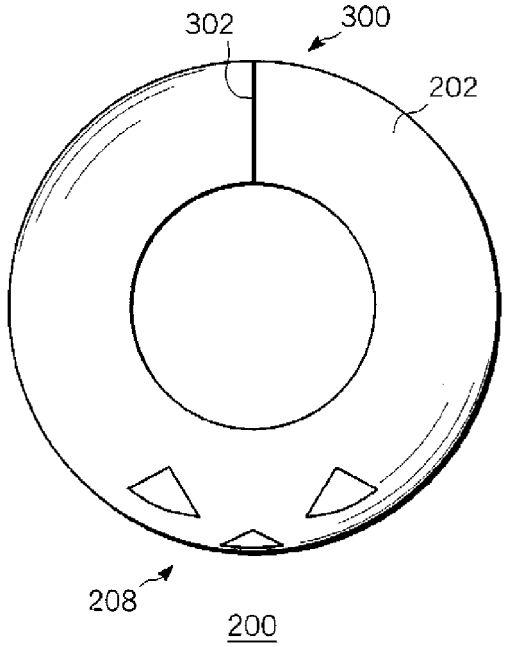
FIG. 3 is a top plan view of the decorative skin of FIG. 2 in a closed/secured position.
Figure 4:
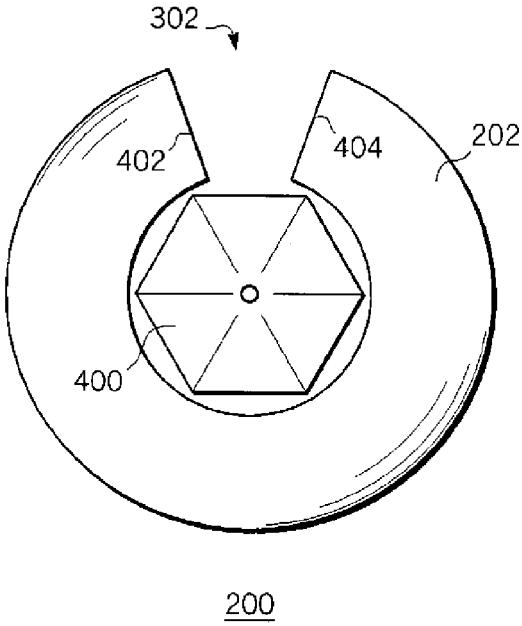
FIG. 4 is a top plan view of the decorative skin of FIG. 3 in a partially opened position.

As shown in the top view of FIG. 3, one side 300 of the skin 200 has an opening 302 that will allow the cover 200 to be placed onto a lamp. The opening 302, in one embodiment, is simply a separation, or discontinuity, of the skin 202, where the material, e.g., of plastic, is able to separate. If the material is semi-rigid, the opening 302 can be placed in the open position, as shown in FIG. 4, by temporarily deforming, bending, or flexing the skin 202 to separate two sides 402 and 404 of the opening 302. Once the two sides 402 and 404 of the skin 202 are separated, the cover 200 can be placed around a light fixture 400 and allowed to return to its steady state closed position, as shown in FIG. 3.

Once around the light fixture 400, the skin 202 is rigid enough to adhere to the fixture 400 and retain its original shape, for example, as shown in FIGS. 2 and 3. As stated above, once the cover 200 is around the light fixture 400, and the light fixture 400 is on and radiating light, the cover 200, in one embodiment, is of an at least partially translucent material that is able to receive light from the light-radiating portion (bulb) of the light fixture 400 and allow the light to pass through and project away from the skin 202. The translucent attribute of the skin 202 allows the decorative cover to be visible at night from a distance and will allow the ornamental design 208 to be easily seen. Providing the skin material 202 in a variety of colors provides multiple visual choices.

Figure 5:
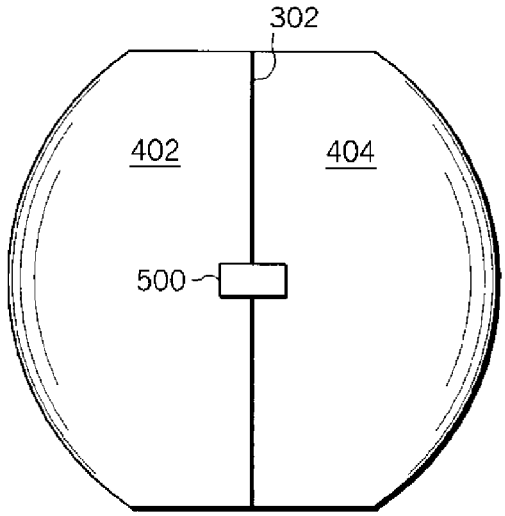
FIG. 5 is a rear elevational view of the skin of FIG. 3 in the closed position with a clasp holding the skin closed.

FIG. 5 is an elevational rear view of the decorative cover 200 showing the opening 302 in a closed position. In this exemplary embodiment, a fastener 500 is attached to one or both of the sides 402 and 404 of the opening 302 and is able to couple one of the sides 402 of the opening 302 to the other side 404 of the opening 302. The fastener 500 can be one or more snaps, VELCRO, hooks, tape, an interlocking mechanism, a combination thereof, or many more.

Figure 6:
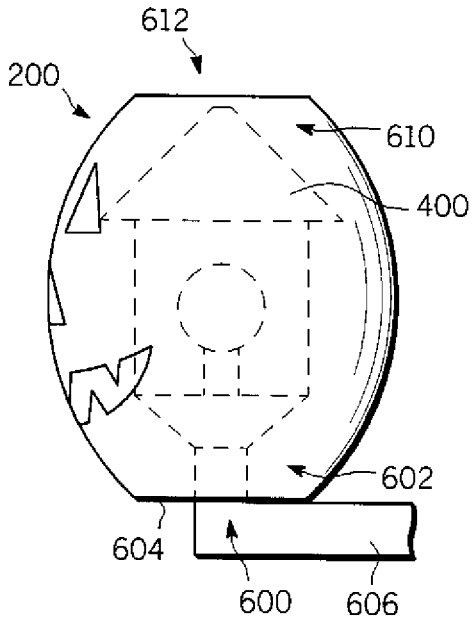
FIG. 6 is an elevational side view of the skin of FIG. 2 attached to the light source of FIG. 1 in accordance with an exemplary embodiment of the present invention.

FIG. 6 shows an elevational side view of the present invention 200 attached to an exterior light fixture 400. As can be seen in this view, the decorative cover 200 has an opening 600 at a bottom end 602 thereof. An edge 604 of the opening 600 presents a structure support portion of the cover 200 and rests against an attachment post 606 of the light fixture 400 and supports the cover 200 in its balanced position on and around the light fixture 400. In one embodiment of the present invention, the decorative cover 200 does not have an opening along the back side 608. In this embodiment, the cover 200 can be attached to the light fixture 400 by sliding the opening 600 in the bottom end 602 of the cover 200 over the lamp fixture 400. If the opening 600 is sufficiently large, it will easily slide over the lamp 400. If desired, the lower extremity can be made of a material that expands to stretch over the lamp fixture 400.

The top portion 610 can also have an opening 612. The opening 612 advantageously allows heat to escape and reduces the likelihood that the cover 200 will melt or otherwise be damaged by the heat. In other embodiments, there is no opening in the top portion 610.

Figure 7:
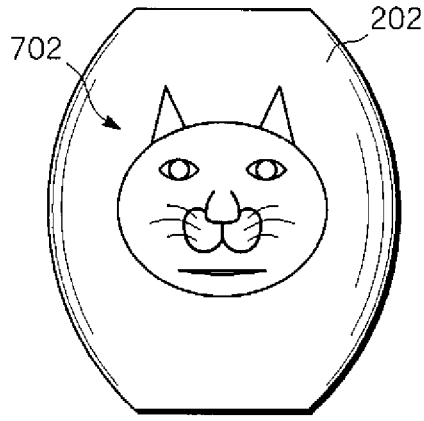
FIG. 7 is an elevational front view of another exemplary embodiment of a skin in accordance with the present invention with a decoration thereon.
Figure 8:
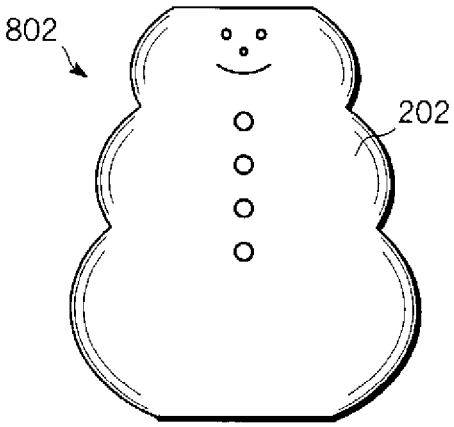
FIG. 8 is an elevational front view of a further exemplary embodiment of a skin in accordance with the present invention having an exterior shape.
Figure 9:
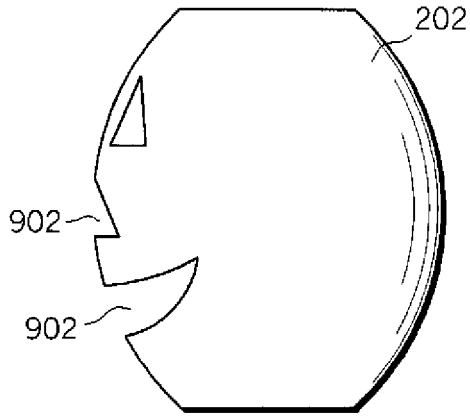
FIG. 9 is an elevational side view of yet another exemplary embodiment of a skin in accordance with the present invention with indentions forming a decoration.
Figure 10:
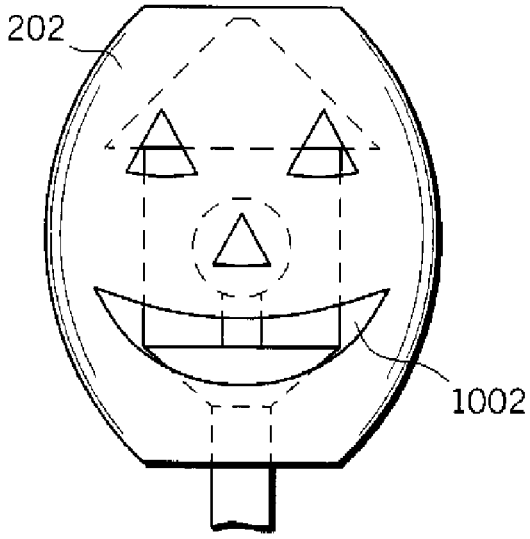
FIG. 10 is a partially hidden and elevational front view of still another exemplary embodiment of a skin in accordance with the present invention with a decoration formed by removing portions of the skin.
Figure 11:
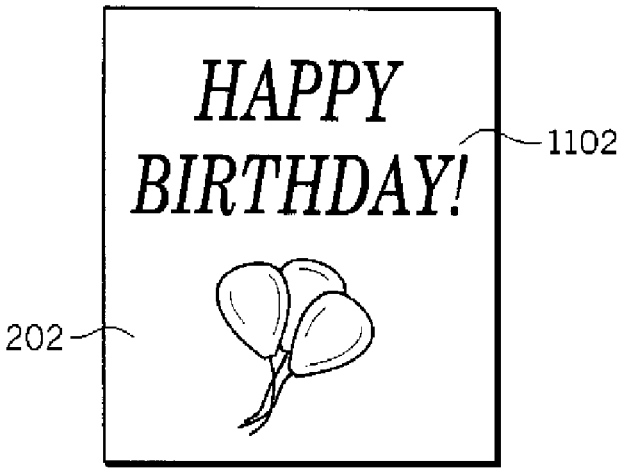
FIG. 11 is an elevational front view of another exemplary embodiment of a skin in accordance with the present invention with a partially textual decoration thereon.

FIGS. 7-11 show several examples of alternative ornamental designs that can be placed on the skin 202 of the cover 200. The design can be drawn 702 onto the skin 202, as shown in FIG. 7, or, as shown in FIG. 8, can be an exterior shape 802 of the cover 200. In the shaped embodiments, the skin can be shaped as a holiday figure, such as a snowman (shown in FIG. 8), an Easter bunny, a birthday present, and many others. The design can also be, as shown in FIG. 9, indentions 902 into the skin material 202 or, as shown in FIG. 10, removed portions 1002 of the skin material 202. The ornamental design does not have to be a shape, but can instead or additionally, be text 1102 placed on the cover 200, as shown in FIG. 11.

A decorative cover has been disclosed that easily slides onto or over a light fixture and produces a decorative effect that allows self-expression or that reminds others of holidays and/or other special events. The decorative cover is easy to install and remove and, advantageously, does not require the installation of additional electrical wires or a separate power source.

What is claimed is:

1. A light cover comprising:

a body defining:

an interior void for receiving therein a light source affixed to a structure;

an exterior surrounding the void and having an ornamental design;

an expandable opening in a first portion of the exterior, the expandable opening allowing access to the interior void and having:

a closed position in which the exterior has a steady state shape; and an open position in which a portion of the exterior is flexibly deformed from the steady state shape and the light source can be inserted into the interior void; and a structure support portion at the opening shaped to support and balance the body on the light source when inserted within the interior, wherein the ornamental design and at least a portion of the body surrounding the ornamental design have differing translucences such that light emitted from the void enhances visibility of the ornamental design from outside the skin.

2. The light cover according to claim 1, wherein:

the body is at least partially plastic.

3. The light cover according to claim 1, wherein:

the ornamental design is at least partially defined by recessed areas in the body.

4. The light cover according to claim 1, wherein the ornamental design comprises at least one of:

a holiday-related image; and a holiday-related shape.

5. The light cover according to claim 1, wherein the ornamental design comprises text.

6. The light cover according to claim 1, wherein:

the opening has first and second sides; and a fastener is attached to the opening and selectively couples the first side to the second side.

7. The light cover according to claim 1, wherein:

the body has a bottom portion; and the opening is at the bottom portion.

8. The light cover according to claim 1, wherein:

the shape is at least one of curved, square, and a holiday figure.

9. The light cover according to claim 1, wherein:

the closed position is a steady state of the body; and the opened position is a temporary deformation of a shape of the body.

10. An ornament comprising:

a skin having:

an exterior defining an interior and having a steady state shape;

an opening having flexibly deformable sides, the opening being shaped to accept a light source into the interior of the skin when the exterior is flexibly deformed into an open state, the steady state shape elastically biasing the skin to a steady state closed position about the light source when the exterior is released to thereby cover the light source;

a decorative portion on the exterior surrounding the interior; and a translucence allowing light to pass from the light source, through the skin, and away from the skin.

11. The ornament according to claim 10, wherein:

the light source is attached to a building.

12. The ornament according to claim 10, wherein:

the skin is a substantially rigid material.

13. The ornament according to claim 10, wherein:

the skin is shaped to define a void within the skin.

14. The ornament according to claim 10, wherein:

the skin is removably attachable to the light source.

15. The ornament according to claim 10, wherein the decorative portion comprises:

a shape of the skin.

16. A cover for covering an exterior lamp attached to a building, the cover comprising:

a skin having:

a shape defining a lamp-holding void;

a holiday-related design on an exterior of the skin surrounding the lamp-holding void;

an opening having an open position and a closed position, the closed position being a natural resting shape of the skin, the open position being a flexibly-deformed state of the skin from the natural resting shape and the opening providing access for the lamp to enter the void when the opening is flexibly deformed to the open position;

a closing mechanism operable to secure the opening in the closed position; and a translucence for allowing light to pass from the lamp in the void, through the skin, and away from the skin.

* * * * *